US006614191B2

(12) United States Patent
Van Lydegraf

(10) Patent No.: US 6,614,191 B2
(45) Date of Patent: Sep. 2, 2003

(54) SYSTEM AND METHOD FOR ILLUMINATING LIGHT EMITTING DIODES IN A CONTACT IMAGE SENSOR

(75) Inventor: Curt Van Lydegraf, Eagle, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 101 days.

(21) Appl. No.: 09/776,069

(22) Filed: Feb. 2, 2001

(65) Prior Publication Data

US 2002/0105287 A1 Aug. 8, 2002

(51) Int. Cl.[7] ..... H05B 41/36
(52) U.S. Cl. ..... 315/291; 347/130
(58) Field of Search ..... 315/291, 194, 315/294, 297, 302, 307, 308, 309; 347/129, 130, 225; 362/800

(56) References Cited

U.S. PATENT DOCUMENTS 5,771,286 A * 6/1998 Dasgupta ..... 315/169.3
6,166,757 A * 12/2000 Murano ..... 347/145
6,285,139 B1 * 9/2001 Ghanem ..... 307/60

OTHER PUBLICATIONS

Gray, Paul R.; Meyer, Robert G., Analysis and Design of Analog Integrated Circuits, John Wiley & Sons, 2nd Edition pp. 702–765 (1984).

* cited by examiner

*Primary Examiner*—Don Wong
*Assistant Examiner*—Thuy Vinh Tran

(57) ABSTRACT

A circuit and method are provided for generating light to illuminate a subject such as a print medium for scanning using, for example, a contact image sensor. The circuit includes a light emitting diode and a variable current control circuit coupled to the light emitting diode. The variable current control circuit is configured to establish a current through the light emitting diode, the magnitude of the current being variable. The variable current control circuit includes a programmable current sink. Alternatively, the variable current control circuit may also include an offset current sink. The programmable current sink and the offset current sink (if included) are employed to establish the variable current through the light emitting diode.

21 Claims, 4 Drawing Sheets

100
106
103b
103g
103r
B
G
R
$V_S$
PCS 109b
PCS 109g
PCS 109r
OCS 113b
OCS 113g
OCS 113r
nBen
nGen
nRen
$I_{ref2b}$
$I_{ref2g}$
$I_{ref2r}$
nBbit
nGbit
nRbit
116b
116g
116r
$I_{ref1b}$
$I_{ref1g}$
$I_{ref1r}$
Band Gap Voltage Reference 119
$V_R$
Mirror Circuit 123
$I_{ref1r\ out}$
$I_{ref1g\ out}$
$I_{ref1b\ out}$
$I_{ref2r\ out}$
$I_{ref2g\ out}$
$I_{ref2b\ out}$
126
129
R1
R2
$i_R$

166

| mA | nR/G/Bbit<0> | nR/G/Bbit <1> | nR/G/Bbit <2> | nR/G/Ben |
|---|---|---|---|---|
| 20 | 1 | 1 | 1 | 0 |
| 25 | 0 | 1 | 1 | 0 |
| 30 | 1 | 0 | 1 | 0 |
| 35 | 0 | 0 | 1 | 0 |
| 40 | 1 | 1 | 0 | 0 |
| 45 | 0 | 1 | 0 | 0 |
| 50 | 1 | 0 | 0 | 0 |
| 55 | 0 | 0 | 0 | 0 |

FIG. 4

SYSTEM AND METHOD FOR ILLUMINATING LIGHT EMITTING DIODES IN A CONTACT IMAGE SENSOR

TECHNICAL FIELD

The present invention is generally related to the field of scanners and, more particularly, is related to the illumination of light emitting diodes in a contact image sensor in a scanner.

BACKGROUND OF THE INVENTION

Conventional scanners that employ contact image sensors typically employ light emitting diodes (LED) to illuminate the subject that is scanned. Such a subject may be, for example, a document. The light that reflects from the subject is sensed by a multitude of sensors in the contact image sensor that generates corresponding signals that are representative of the scanned subject as is generally known by those with ordinary skill in the art.

To illuminate the subject to be scanned, a light pipe is typically employed to distribute light generated by a single LED across the entire subject to be scanned, thereby providing light that can be sensed by the entire contact image sensor. For color scanners, typically three different LED's of different colors are used such as a red, green, and blue. These different color LED's are switched on at different times to obtain three respective exposures of each dot or pixel on the subject scanned.

In one conventional configuration, each of the LED's is coupled to a power supply with a series resistor. In this configuration, the combination of the power supply voltage, the resistance of the series resistor, and the forward voltage of the specific LED determine the current through the LED which, in turn, determines the light output from the LED. Unfortunately, the forward voltage of each of the LED's and the resistance of the resistor often vary due to production process variation and other factors. Also, the power supply voltage may vary due to environmental conditions such as temperature, etc. Due to the combination of the variations noted above, the resulting current through each of the LED's generally varies greatly, thereby resulting in significant variation in the light output generated by each of the LED's. In addition, variation in other aspects of the image scanner system such as the sensitivity of the contact image sensors results in corresponding variation of the required amount of light that should be generated by each of the LED's. For example, the sensitivity of the contact image sensors may vary over time with repeated use.

In another conventional design, a constant current source is employed with each of the LED's to ensure a fixed current flows therethrough. However, this design is subject to the problem of the variation in the manufacturing of the LED's. In particular, for a number of LED's created in a single batch, a distribution of light output results among the LED's in the batch. That is to say, the same current flowing through each LED in a batch will result in a different light output for each LED. In addition, such a constant current source does not address the variation in the other aspects of the image scanner system that may require a different amount of light than that which is produced by the LED's that are driven by a constant current source.

As a consequence of the foregoing, LED's in conventional image scanner systems generate less than optimum light outputs based upon the needs of the contact image sensors, thereby negatively impacting the quality of resulting scanned images.

SUMMARY OF THE INVENTION

In light of the foregoing, the present invention provides for a circuit and method for generating light to illuminate a subject such as a print medium for scanning using, for example, a contact image sensor. According to one embodiment, the circuit includes a light emitting diode and a variable current control circuit coupled to the light emitting diode. The variable current control circuit is configured to establish a current through the light emitting diode, the magnitude of the current being variable. The variable current control circuit includes a programmable current sink. Alternatively, the variable current control circuit may also include an offset current sink. The programmable current sink and the offset current sink (if included) are employed to establish the variable current through the light emitting diode.

The variable current control circuit further includes a reference current circuit generating a reference current based upon a band gap voltage reference. Both the programmable current sink and the offset current sink (if included) are referenced from the reference current. The use of the band gap voltage reference allows the creation of the reference current with little susceptibility to fluctuation due to changes in temperature or other environmental factors. The circuit further comprises a current control register that is coupled to a current control input of the programmable current sink. The magnitude of the current established through the LED varies with reference to a current control value stored in the current control register.

The present invention may also be viewed as a method for generating light. The present method comprises the steps of: generating a current through a light emitting diode to create a light output, and, varying a magnitude of the current, thereby causing a corresponding variation in the light output. In the present method, the step of varying the magnitude of the current may further comprise the step of varying the magnitude of the current among a number of discrete current levels. Also, the step of varying the magnitude of the current may further comprise the step of varying the magnitude of the current with a programmable current sink. In addition, the step of generating the current through the light emitting diode to create the light output may further comprise the step of generating the current with an offset current sink.

In order to reference the programmable current sink, the step of varying the magnitude of the current with the programmable current sink further comprises the step of generating a reference current to reference the programmable current sink. Alternatively, the step of generating the current with the offset current sink may further comprise the step of generating a reference current to reference the offset current sink.

The step of generating a reference current to reference the programmable current sink or the offset current sink may include, for example, the step of generating the reference current based upon a band gap voltage reference. This is done, for example, to ensure that the reference current generated is constant even in the presence of temperature fluctuation or other environmental changes.

Other features and advantages of the present invention will become apparent to a person with ordinary skill in the art in view of the following drawings and detailed description. It is intended that all such additional features and advantages be included herein within the scope of the present invention.

BRIEF DESCRIPTION OF THE DRAWINGS

The invention can be understood with reference to the following drawings. The components in the drawings are not necessarily to scale. Also, in the drawings, like reference numerals designate corresponding parts throughout the several views.

FIG. 4 is a table that details the corresponding logical values employed in the LED illumination control circuit of FIG. 1 to generate respective LED currents.

DETAILED DESCRIPTION OF THE INVENTION

Figure 1:
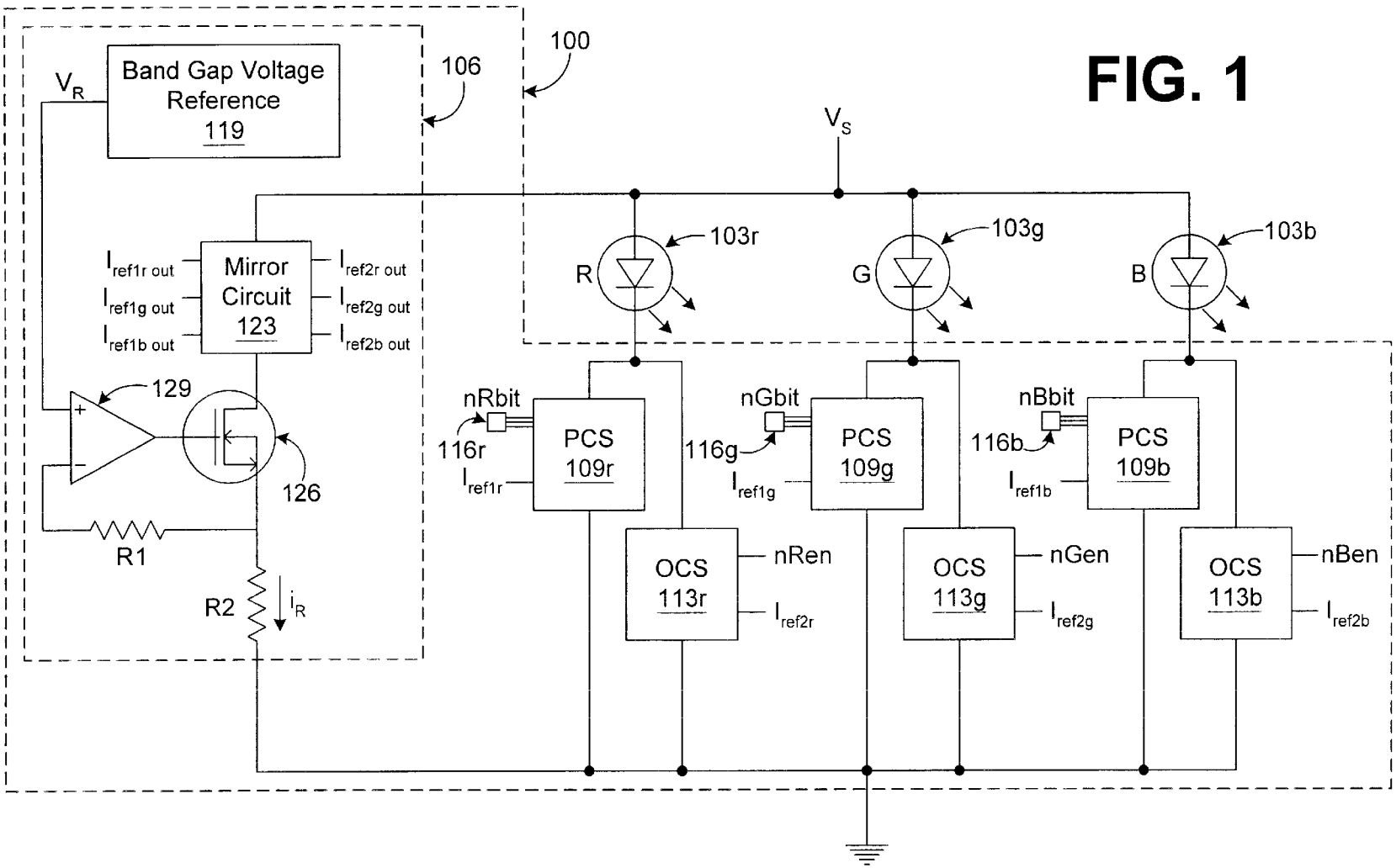
FIG. 1 is a schematic of a light emitting diode (LED) illumination control circuit according to an embodiment of the present invention.

With reference to FIG. 1, shown is a variable current control circuit 100 according to an embodiment of the present invention. The variable current control circuit 100 is employed to generate a variable current through a red light emitting diode (LED) 103*r*, a green LED 103*g*, and a blue LED 103*b* that are coupled to the variable current control circuit 100 as shown. The LED's 103*r*, 103*g*, and 103*b* may be employed, for example, to illuminate a print medium or other subject to be scanned by a contact image sensor (CIS) or for some other purpose. The specific use of a contact image sensor to sense an image is well known to those with ordinary skill in the art, and, therefore is not discussed in detail herein.

The variable current control circuit 100 includes a current reference circuit 106; a number of programmable current sinks 109*r*, 109*g*, and 109*b*; and a number of offset current sinks 113*r*, 113*g*, and 113*b*. The programmable and offset current sinks 109*r* and 113*r* are coupled in parallel between the red LED 103*r* and ground. Also, the programmable and offset current sinks 109*g* and 113*g* are coupled in parallel between the green LED 103*g* and ground, and, the programmable and offset current sinks 109*b* and 113*b* are coupled in parallel between the blue LED 103*b* and ground. The red, green, and blue LED's 103*r*, 103*g*, and 103*b* are also coupled to a voltage source $V_s$ as shown. The respective parallel pairs of programmable current sinks 103*r*, 103*g*, 103*b* and offset current sinks 113*r*, 113*g*, and 113*b* are employed to establish variable current through the respective LED's 103*r*, 103*g*, and 103*b*. Note that LED's of different color than red, green, or blue may be employed with the variable current control circuit 100.

The variable current control circuit 100 also includes current control registers 116*r*, 116*g*, and 116*b*. Each of the current control registers 116*r*, 116*g*, and 116*b* are coupled to a current control input of each of the programmable current sinks 109*r*, 109*g*, and 109*b*, respectively. The programmable current sinks 109*r*, 109*g*, and 109*b* also include reference current inputs. The reference current inputs receive reference currents $I_{ref1r}$, $I_{ref1g}$, and $I_{ref1b}$. Similarly, the offset current sinks 113*r*, 113*g*, and 113*b* receive reference currents $I_{ref2r}$, $I_{ref2g}$, and $I_{rf2b}$. The offset current sinks 113*r*, 113*g*, and 113*b* also receive inverted enabling inputs nRen, nGen, and nBen, respectively.

The current reference circuit 106 includes a band gap voltage reference 119, a mirror circuit 123, a reference circuit transistor 126, an operational amplifier 129, a reference resistor R2, and a feedback resistor R1. The band gap voltage reference 119 produces a reference voltage $V_R$ that is applied to the non-inverting input of the operational amplifier 129. The output of the operational amplifier 129 is coupled to the gate of the reference current transistor 126. The source of the reference current transistor 126 is coupled to both the reference resistor R2 and the feedback resistor R1. The feedback resistor R1 is also coupled to the inverting input of the operational amplifier 129. The voltage supply $V_s$ is coupled to the mirror circuit 123 which, in turn, is coupled to the drain of the reference current transistor 126. The mirror circuit 123 creates a number of reference currents $I_{refX}$ as shown that are applied to the respective programmable current sinks 109*r*, 109*g*, and 109*b* and to the offset current sinks 113*r*, 113*g*, and 113*b*. Note that the reference current transistor 126 may be, for example, a metal-oxide semiconductor field-effect transistor or other type of transistor.

Next a discussion of the operation of the variable current control circuit 100 is provided. To begin, the band gap voltage reference 119 generates a reference voltage $V_R$ that is applied to the non-inverting input of the operational amplifier 129. The band gap voltage reference 119 is advantageously used to generate the reference voltage $V_R$ so that the reference voltage $V_R$ is subject to little fluctuation due to changes in operating temperature of the band gap voltage reference 119, etc. The combined circuit of the operational amplifier 129, the reference current transistor 126, the reference resistor R2, and the feedback resistor R1 is employed to generate a constant reference current $i_R$. The reference current $i_R$ flows from the voltage source $V_s$ through the mirror circuit 123, the reference current transistor 126, and the reference resistor R2 to ground.

The mirror circuit 123 then generates the reference currents $I_{refX}$ based upon the reference current $i_R$. The reference currents $I_{refX}$ are then applied to the respective programmable current sinks 109*r*, 109*g*, and 109*b* and offset current sinks 113*r*, 113*g*, and 113*b*. The programmable current sinks 109*r*, 109*g*, and 109*b* thus establish a variable current flow through their respective LED's 103*r*, 103*g*, and 103*b*, the established current flow being referenced to the reference currents $I_{ref1r}$, $I_{ref1g}$ and $I_{ref1b}$. The actual value of the current established by each of the programmable current sinks 109*r*, 109*g*, and 109*b* is determined by a current control value that is stored in the current control registers 116*r*, 116*g*, and 116*b*, respectively.

In addition, the offset current sinks 113*r*, 113*g*, and 113*b* establish a constant current flow to ground from the voltage source $V_S$ and through the respective LED's 103*r*, 103*g*, and 103*b*. Thus the currents established by the programmable current sinks 109*r*, 109*g*, and 109*b* and the offset current sinks 113*r*, 113*g*, and 113*b* flow through the respective LED's 103*r*, 103*g*, and 103*b*. Also the currents established by the programmable current sinks 109*r*, 109*g*, and 109*b* and the offset current sinks 113*r*, 113*g*, and 113*b* are referenced back to the reference current $i_R$, which in turn is referenced to the reference voltage $V_R$ generated by the band gap voltage reference 119. Consequently, the current flowing through the respective LED's 103*r*, 103*g*, and 103*b* are quite accurate based on the accuracy of the reference voltage $V_R$.

By controlling the current control values stored in the current control registers 116*r*, 116*g*, and 116*b*, the precise amount of current flowing through the programmable current sinks 109*r*, 109*g*, and 109*b* is controlled. Thus, the amount of current that flows through the LED's 103*r*, 103*g*, and 103*b* equals the added total current established by both the programmable current sinks 109*r*, 109*g*, and 109*b* and the respective offset current sinks 113*r*, 113*g*, and 113*b*. By placing appropriate current control values in the current control registers 116*r*, 116*g*, and 116*b*, the precise current flowing through the respective LED's 103*r*, 103*g*, and 103*b* can be controlled across a predetermined current range.

Figure 2:
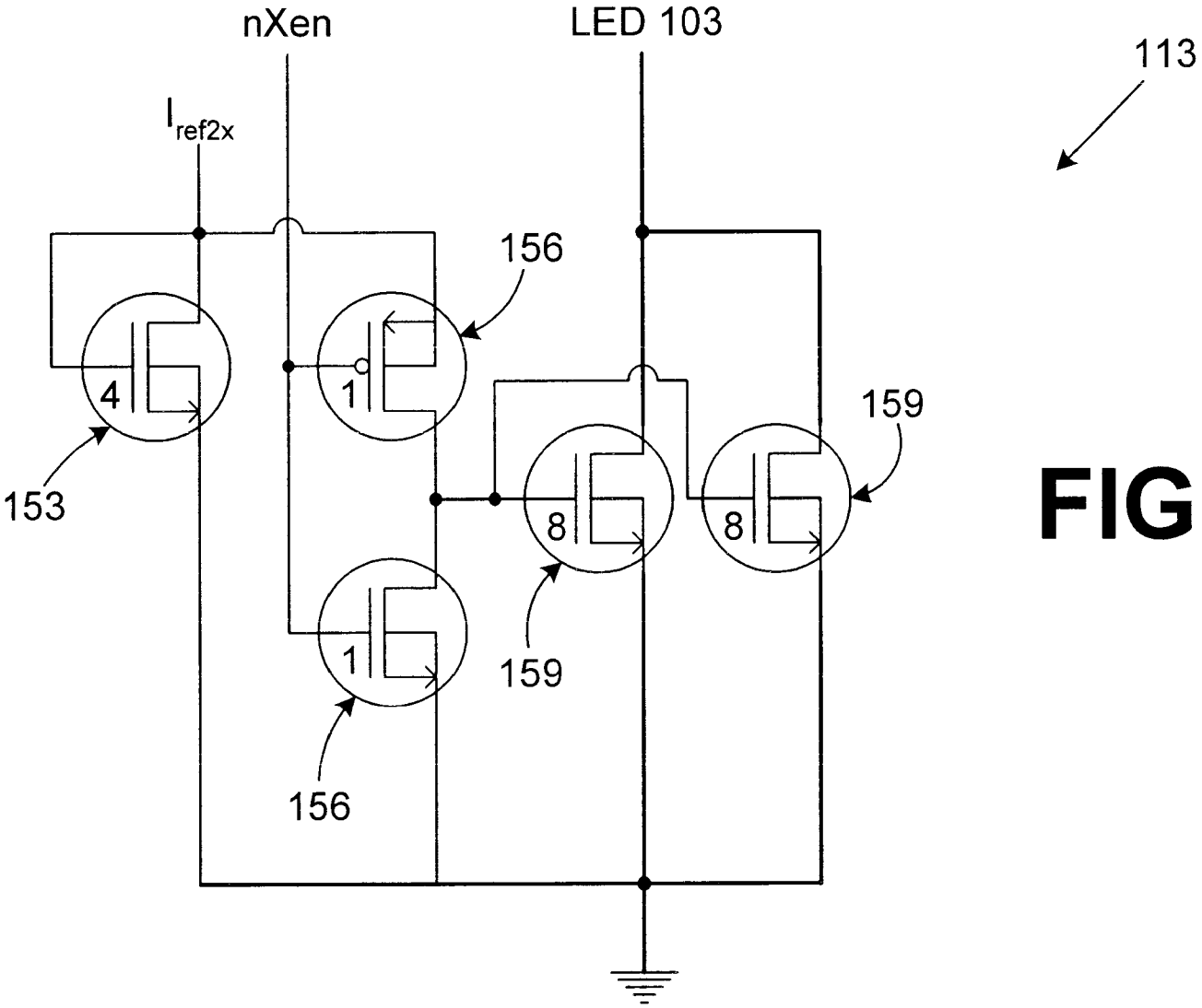
FIG. 2 is a schematic of an offset current sink employed in the LED illumination control circuit of FIG. 1.

With reference to FIG. 2, shown is a schematic of an offset current sink 113 that is used as the offset current sinks 113*r*, 113*g*, or 113*b* according to an aspect of the present invention. The offset current sink 113 includes a reference transistor 153, a pair of enabling transistors 156, and a pair of mirror transistors 159. The offset current sink 113 is designed, for example, to operate in a manner similar to a mirror circuit. Specifically, the reference current $I_{ref2x}$ that flows through the reference transistor 153 is mirrored to the mirror transistors 159, accordingly. The reference transistor 153 includes four gates as indicated by the number "4" displayed therein. The mirror transistors 159 each include eight gates as indicated by the number "8" included therein. Thus, the magnitude of the current established by each of the mirrored transistors 159 is twice the magnitude of the current flowing through the reference transistor 153.

Thus, if the reference current $I_{refx}$ is equal to five milliamps, then the resulting current flowing through the respective LED 103*r*, 103*g*, or 103*b* as established by the activation of the mirror transistors 159 is twenty milliamps. It is understood that other magnitudes of current may be established in addition to those cited herein. The inverting enable input nXen causes the enabling transistors 156 to turn the mirror transistors 159 on or off, accordingly. The inverting enable input nXen may be generated, for example, by using appropriate state circuitry as is generally known by those with ordinary skill in the art. Thus, the offset current sink 113 generates a constant current when enabled as discussed with reference to FIG. 2. This constant current is a first component of the total current that flows through the respective LED 103*r*, 103*g*, or 103*b*.

Figure 3:
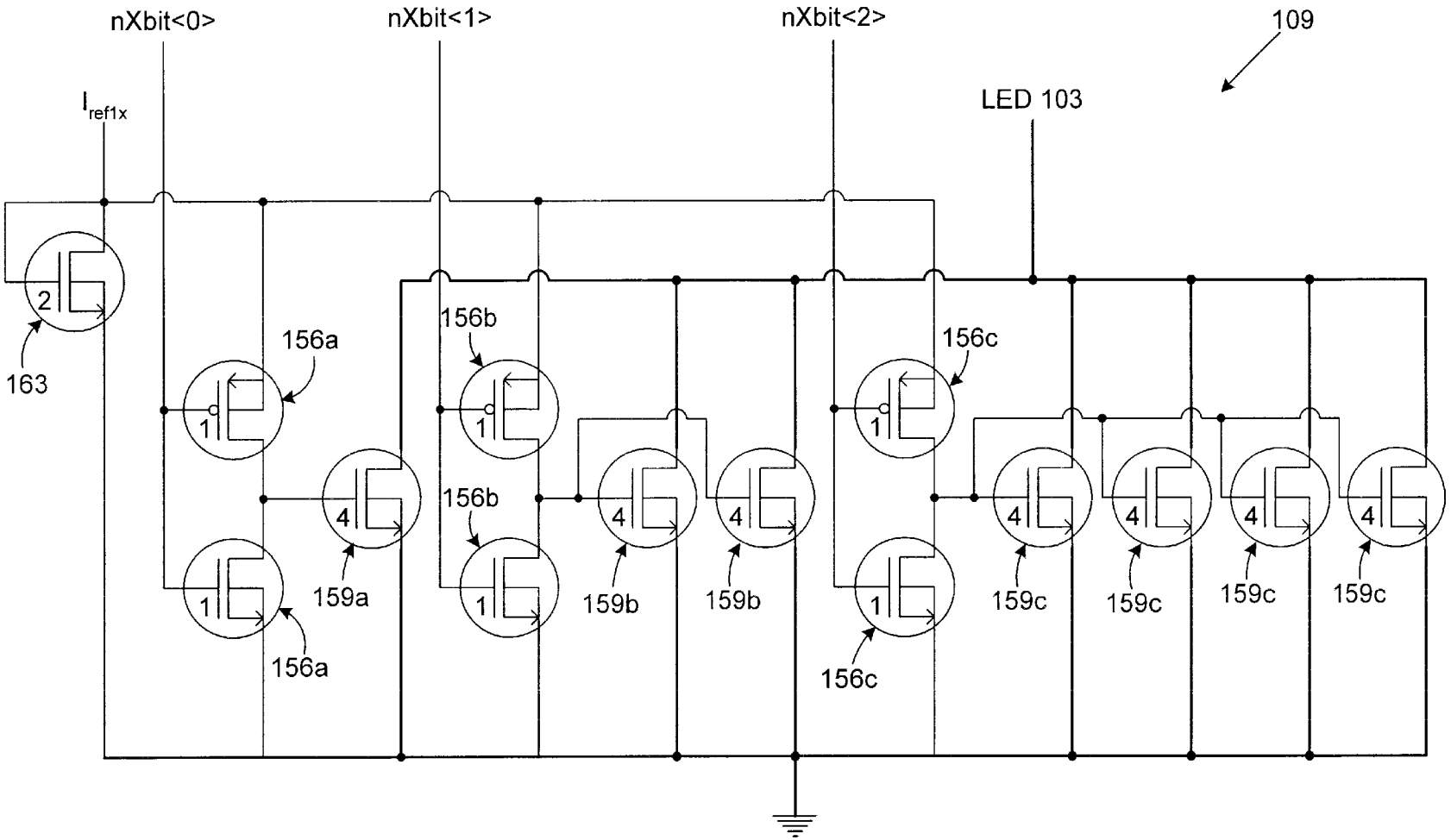
FIG. 3 is a schematic of a programmable current sink employed in the LED illumination control circuit of FIG. 1.

With reference to FIG. 3, shown is a schematic of a programmable current sink 109 that is employed as the programmable current sinks 109*r* (FIG. 1), 109*g* (FIG. 1), and 109*b* (FIG. 1) according to an aspect of the present invention. The programmable current sink 109 employs current mirrors to generate the variable current through the respective LED 103 (FIG. 1). In particular, the programmable current sink 109 includes a reference transistor 163 to which the reference current $I_{ref1x}$ is applied. Based on the enabling input bits nXbit <0–2>, each of three portions of the programmable current sink 109 may be activated to establish a predetermined current flow through a respective LED 103. Specifically, for example, if the enable bit nXbit<0> is set low, then the enabling transistors 156*a* cause the mirror transistor 159*a* to conduct current. The mirror transistor 159*a* conducts twice the amount of current as the reference transistor 163 based on the number of gates of the mirror transistor 159*a* relative to the number of gates of the reference transistor 163. Likewise, the enable bit nXbit<1> activates the enable transistors 156*b* which, in turn, activate the mirror transistors 159*b*. The mirror transistors 159*b* thus create a current that is four times greater than the reference current $I_{ref1x}$. Finally, if the enable bit nXbit<2> activates the enable transistors 156*c*, then the respective mirror transistors 159*c* are enabled, thereby allowing eight times the reference current $I_{ref1x}$ to flow through the respective LED 103*r*, 103*g*, or 103*b*.

By activating a combination of the mirror transistors 159*a*, 159*b*, and/or 159*c*, various combinations of current flowing through the respective LED 103*r*, 103*g*, or 103*b* may be established. For example, assuming that the reference current $I_{ref1x}$ is equal to 2.5 milliamps, then enabling the mirror transistor 159*a* allows 5 milliamps to flow through the respective LED 103*r*, 103*g*, or 103*b*. Similarly, activating the mirror transistors 159*b* causes 10 milliamps and enabling the mirror transistors 159*c* causes 20 milliamps to flow through the respective LED 103*r*, 103*g*, or 103*b*. By selectively activating the mirror transistors 159*a*, 159*b*, and 159*c*, currents in the amounts of 5 milliamps up to 35 milliamps may be established through the respective LED 103*r*, 103*g*, or 103*b* at 5 milliamp intervals. In this manner, the programmable current sink 109 may be controlled to vary the current flowing through the respective LED 103*r*, 103*g*, or 103*b* based on predefined criteria. In addition, to establish currents other than the 5–35 milliamp range described above, the relative number of gates in the reference transistor 163 and the mirror transistors 159*a–c* may be altered. The same concept applies to the offset current sinks 113*r*, 113*g*, and 113*b* (FIG. 1), respectively. In addition, a different current mirror configuration other than that shown in the programmable current sink 109 may be employed as well operating under similar principles as discussed herein.

Finally, with reference to FIG. 4, shown is a table 166 that illustrates the values of the enable bits nXbit<0–2> with respect to the desired current in milliamps to be established through the LED's 103*r*, 103*g*, or 103*b* (FIG. 1). The enable bits nXbit<0–2> may be generated, for example, with appropriate state circuitry, etc. The table 166 assumes that the current of 20 milliamps established by the respective offset current sinks 113*r*, 113*g*, and 113*b* (FIG. 1) is included to offset the variable current established by the respective programmable current sinks 109*r*, 109*g*, and 109*b* (FIG. 1). It is understood, however, that the offset current sinks 113*r*, 113*g*, and 113*b* may not be employed or may be changed to alter the offset of the variable current.

In addition, it is understood that electrical design of the programmable current sinks 109*r*, 109*g*, and 109*b* and the offset current sinks 113*r*, 113*g*, and 113*b* are subject to variation to achieve different desired current levels or other advantages, etc. For example, the offset current sinks 113 (FIG. 2) may be combined into a single circuit that requires a single reference current $I_{ref2}$. Also, in some situations, the offset current sink 113 may not be employed in cases where the desired range of currents to flow through the LED's 103 does not need the additional offset current. Alternatively, the offset current sinks 113 (FIG. 2) may be incorporated into the programmable current sinks 109 (FIG. 3). In addition, it may possible to combine programmable current sinks 109 to reduce the number of reference currents $I_{ref1}$ that are generated.

Although the invention is shown and described with respect to certain preferred embodiments, it is obvious that equivalents and modifications will occur to others skilled in the art upon the reading and understanding of the specification. The present invention includes all such equivalents and modifications, and is limited only by the scope of the claims.

What is claimed is:

1. A circuit for generating light, comprising:

a light emitting diode;

a programmable current sink coupled to the light emitting diode, the programmable current sink including a constant reference current input and the programmable current sink being configured to establish a variable current through the light emitting diode; and an offset current sink coupled to the light emitting diode in parallel with the programmable current sink, the offset current sink being configured to establish a constant offset current through the light emitting diode, wherein a total current flowing through the light emitting diode is equal to a sum of the variable current and the offset current.

2. The circuit of claim 1, further comprising a current control register coupled to the programmable current sink, wherein a magnitude of the variable current depends upon a current control value applied to the current control register.

3. The circuit of claim 2, wherein the programmable current sink further comprises a number of mirror transistors coupled in parallel, wherein the current control value applied to the current control register enables a combination of the mirror transistors, thereby establishing the variable current.

4. The circuit of claim 2, wherein the programmable current sink further comprises a reference transistor, and, each of the mirror transistors generates a current that flows through the light emitting diode, each of the currents having a magnitude that is based upon a reference current applied to the reference transistor, the magnitude of each of the currents being determined based upon a relative gate size between the reference transistor and each of the mirror transistors, respectively.

5. The circuit of claim 1, wherein the programmable current sink consists of a number of interconnected transistors.

6. The circuit of claim 1, further comprising a reference current circuit generating at least one reference current based upon a band gap voltage reference, wherein the at least one reference current is applied to a second constant reference current input of the offset current sink.

7. The circuit of claim 1, further comprising a reference current circuit generating at least one reference current based upon a band gap voltage reference, wherein the at least one reference current is applied to the constant reference current input of the programmable current sink.

8. The circuit of claim 1, further comprising a reference current circuit, the reference current circuit comprising:

a band gap voltage reference that generates a reference voltage;

a circuit to generate a first reference current based upon the reference voltage; and a mirror circuit that generates the at least one second reference current based upon the first reference current.

9. A method for generating light, comprising:

electrically coupling a programmable current sink to a light emitting diode;

electrically coupling an offset current sink to the light emitting diode in parallel with the programmable current sink;

applying a first constant reference current to a reference input of the programmable current sink and a second constant reference current to a reference input of the offset current sink;

establishing a variable current through the light emitting diode with the programmable current sink; and establishing a constant offset current through the light emitting diode with the offset current sink, wherein a total current flowing through the light emitting diode is equal to a sum of the variable current and the offset current.

10. The method of claim 9, further comprising applying a current control value to a current control register associated with the programmable current sink, wherein a magnitude of the variable current depends upon the current control value.

11. The method of claim 10, wherein the establishing of the variable current through the light emitting diode with the programmable current sink further comprises establishing the variable current using a combination of a number of mirror transistors coupled in parallel, wherein the current control value applied to the current control register enables the combination of the number of mirror transistors.

12. The circuit of claim 10, wherein the establishing of the variable current using a combination of a number of mirror transistors coupled in parallel further comprises establishing a current through each of the mirror transistors having a magnitude that is based upon the first constant reference current applied to a reference transistor in the programmable current sink, wherein the magnitude of each of the currents being determined based upon a relative gate size between the reference transistor and each of the mirror transistors, respectively.

13. The method of claim 9, further comprising providing the programmable current sink that consists of a number of interconnected transistors.

14. The method of claim 9, further comprising generating the first and second constant reference currents based upon a band gap voltage reference.

15. The method of claim 14, wherein the generating of the first and second constant reference currents based upon the band gap voltage reference further comprises:

generating a reference voltage with the band gap voltage reference;

generating a first reference current based upon the reference voltage; and generating the first and second constant reference currents with a mirror circuit referenced to the first reference current.

16. A system for generating light, comprising:

first means for generating a variable current through a light emitting diode;

second means for generating a constant offset current through the light emitting diode; and means for generating a first constant reference current that is applied to the first means and a second constant reference current that is applied to the second means, wherein a total current flowing through the light emitting diode is equal to a sum of the variable current and the offset current.

17. The system of claim 16, further comprising means for controlling a magnitude of the variable current.

18. The circuit of claim 16, wherein the means for generating the first and second constant reference currents further comprises a reference current circuit that generates the first and second constant reference currents based upon a band gap voltage reference.

19. The circuit of claim 16, wherein the means for generating the first and second constant reference currents further comprises:

a band gap voltage reference that generates a reference voltage;

a circuit to generate a first reference current based upon the reference voltage; and a mirror circuit that generates the first and second constant reference currents based upon the first reference current.

20. The circuit of claim 16, wherein the first means further comprises a number of mirror transistors coupled an parallel.

21. The circuit of claim 20, wherein the first means further comprises a reference transistor, and, each of the mirror transistors establishes a current that flows through the light emitting diode, each of the currents having a magnitude that is based upon a reference current applied to the reference transistor, the magnitude of each of the currents being determined based upon a relative gate size between the reference transistor and each of the mirror transistors, respectively.

* * * * *

UNITED STATES PATENT AND TRADEMARK OFFICE

CERTIFICATE OF CORRECTION

PATENT NO. : 6,614,191 B2
DATED : September 2, 2003
INVENTOR(S) : Van Lydegraf

It is certified that error appears in the above-identified patent and that said Letters Patent is hereby corrected as shown below:

Column 8,
Line 1, delete “circiuit” and insert therefor -- method --.
Line 56, delete “an” and insert therefor -- in --.

Signed and Sealed this

Thirteenth Day of July, 2004

JON W. DUDAS
*Acting Director of the United States Patent and Trademark Office*